US005200240A

United States Patent [19]

Baker

[11] Patent Number: 5,200,240

[45] Date of Patent: Apr. 6, 1993

[54] ALUMINUM RAILING APPARATUS

[76] Inventor: Neill E. Baker, 13900 - 60th Avenue, Surrey, British Columbia, Canada, V5W 1S7

[21] Appl. No.: 694,300

[22] Filed: May 2, 1991

[51] Int. Cl.[5] ..... E04H 17/14

[52] U.S. Cl. ..... 428/34.1; 428/36.92; 428/122; 428/192; 428/358; 256/59; 256/63; 256/65; 256/73; 52/690; 52/710; 52/184

[58] Field of Search ..... 256/59, 63, 65, 68, 256/73; 52/690, 694, 710, 182, 184; 428/34.1, 36.92, 122, 192, 358

[56] References Cited

U.S. PATENT DOCUMENTS

| | | | |
|---|---|---|---|
| 3,221,467 | 12/1965 | Henkels | 52/690 |
| 4,015,826 | 4/1977 | Lauzier | 256/59 |
| 4,586,697 | 5/1986 | Tornya | 256/59 |
| 4,690,383 | 9/1987 | Batcheller | 256/73 |
| 4,920,717 | 5/1990 | Hooper | 256/59 |

*Primary Examiner*—Ellis P. Robinson
*Assistant Examiner*—Rena L. Dye
*Attorney, Agent, or Firm*—Norman M. Cameron

[57] ABSTRACT

A railing member comprising a hollow extrusion having a picket-receiving channel along the bottom thereof. The channel has an open bottom. The sides of the member have bottom edges which extend downwardly at least as far as the bottom of the channel. A railing assembly includes the top railing member, a bottom railing member below the top railing member, a plurality of spaced-apart support posts extending between the members and a plurality of pickets between the posts. The support posts have flat tops which are received against the bottom of the top railing member and are connected thereto.

11 Claims, 4 Drawing Sheets

FIG. 2
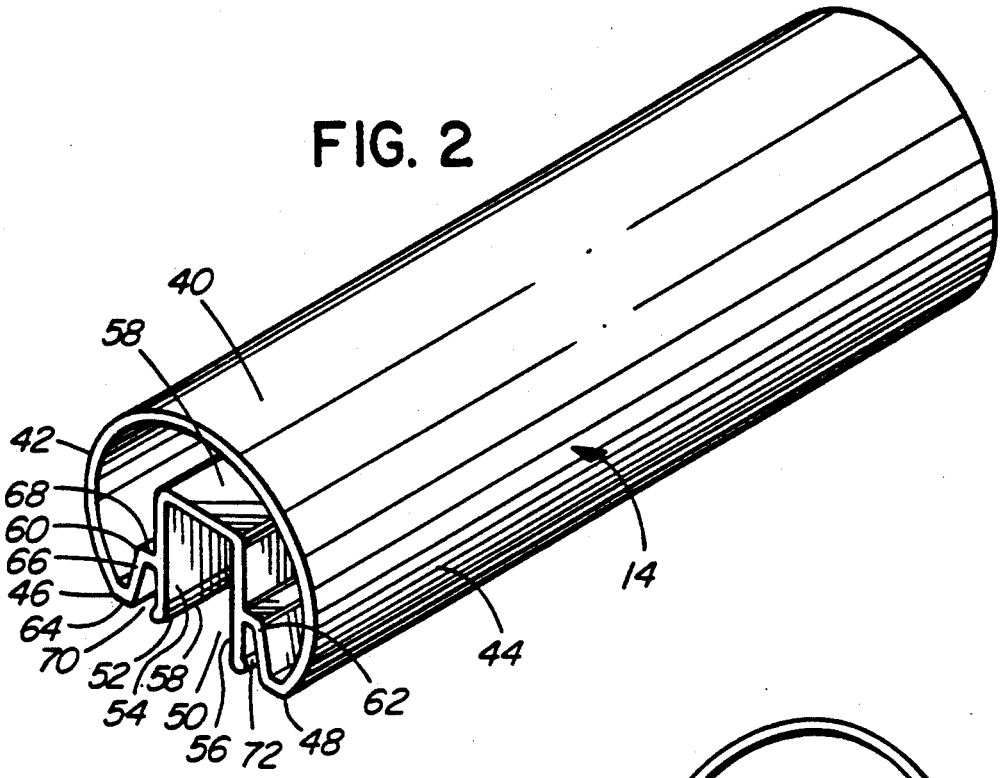
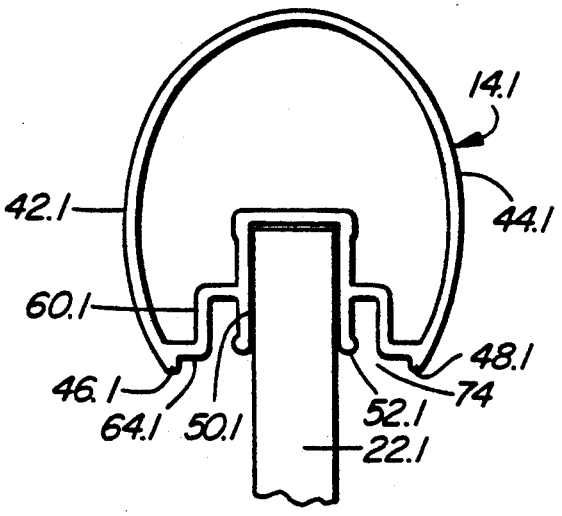
FIG. 3
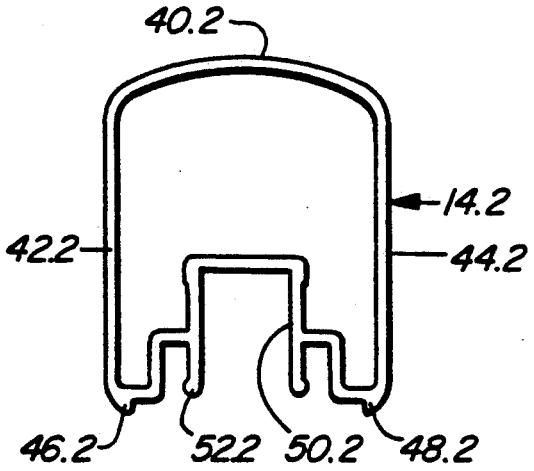
FIG. 4

ALUMINUM RAILING APPARATUS

BACKGROUND OF INFORMATION

1. Field of Invention

This invention relates to an aluminum railing apparatus wherein the top railing member is of extruded aluminum with a relatively flat bottom and having a picket-receiving channel extending inwardly therefrom.

Aluminum railings have many advantages over more traditional railing systems of steel, wrought iron or wood and, consequently, are widely used in many buildings for balconies, elevated decks and the like. They are light in weight, relatively inexpensive and can be painted to match any colour scheme. Furthermore, they have a virtually unlimited life span. However, some prior art aluminum railing systems have offered disadvantages which have limited their market. For example, some systems do not provide a clean, pleasing appearance from all angles, particularly from below as they are seen by reclining sun bathers. Some prior art railing systems have the top railing interrupted at intervals by posts and therefore cannot give long, continuous spans of top railing as often is desired. Some aluminum railing apparatuses have been relatively difficult to assemble on the job site, making labour costs too high. In addition, previous aluminum railing apparatuses have had difficulties meeting the requirements of the applicable building codes.

SUMMARY OF THE INVENTION

The invention addresses these problems associated with prior art aluminum railing apparatuses by providing a railing member comprising a hollow extrusion with a top, sides and a bottom. The bottom has a picket-receiving, longitudinal channel with an open bottom. The sides have bottom edges which extend downwardly at least as far as the bottom of the channel.

The invention also provides a railing assembly which includes a top railing member having a top, sides and a bottom having a picket-receiving, longitudinal channel with an open bottom. The sides have bottom edges which extend downwardly at least as far as the bottom of the channel. There is a bottom railing member below the top railing member which is spaced-apart therefrom. The bottom railing member has a top and a picket-receiving channel with an open end near the top, the channel extending downwardly therefrom. A plurality of spaced-apart support posts extend perpendicularly between the top railing member and the bottom railing member. Each support post has a flat top which is received against the bottom of the top railing member on each side of the picket-receiving channel. A plurality of pickets extend vertically between the railing members. Each picket has a top in the picket receiving channel of the top railing member and a bottom in the picket receiving channel of the bottom railing member.

The invention provides a railing member and a railing assembly which offer significant advantages over prior art top railings and railing assemblies. For example, the relatively flat bottom of the railing member, with the picket-receiving recess extending inwardly therefrom, offers a clean, pleasing appearance from all points of view including the view from below the railing member. Continuous spans without the top railing member being interrupted by posts is possible with the mode of connecting the support posts to the top railing member found in the invention. Assembly on the job site is easy with pickets and associated panels being received in the channel in the top railing member and a similar upward facing channel in the bottom railing member. Posts are easily connected to the top railing member by means of screws or welding.

BRIEF DESCRIPTION OF THE DRAWINGS

In the drawings which illustrate embodiments of the invention:

FIG. 2 is an isometric view of the top railing member of the embodiment of FIG. 1;

FIG. 3 is an end view of a semi-elliptical top railing member, according to an alternative embodiment of the invention, showing a picket-received in the picket-receiving channel thereof, the picket being in fragment;

FIG. 4 is an end view of a top railing member, according to another embodiment of the invention, being generally rectangular in section;

DESCRIPTION OF THE PREFERRED EMBODIMENTS

Figure 1:
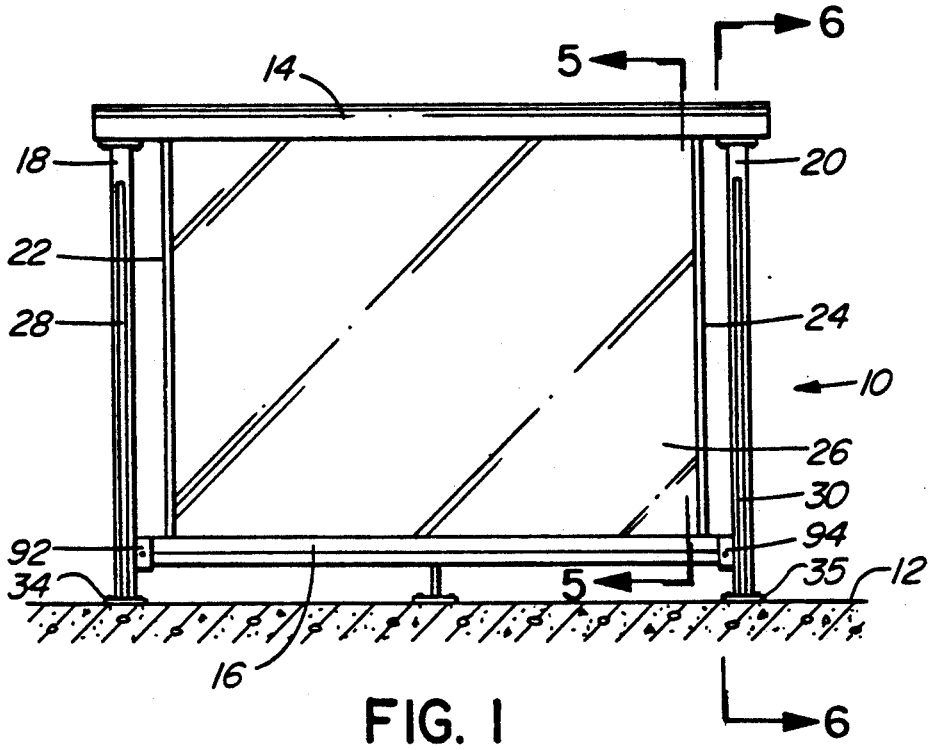
FIG. 1 is a side elevation of a railing apparatus according to an embodiment of the invention.

Referring to FIG. 1, this shows a railing assembly 10 according to an embodiment of the invention. The railing assembly is shown mounted on a concrete surface 12 although it may be mounted on other surfaces as well. The assembly 10 includes a top railing member 14, a bottom railing member 16 and a pair of support posts 18 and 20. A pair of pickets 22 and 24 extend perpendicularly between the top and bottom railing members. In this embodiment there is a glass panel 26 fitted between the pickets and the top and bottom railing members. Alternatively, there could be a larger plurality of pickets 22 and 24 spaced-apart a few inches each in place of the panel 26.

Figure 1A:
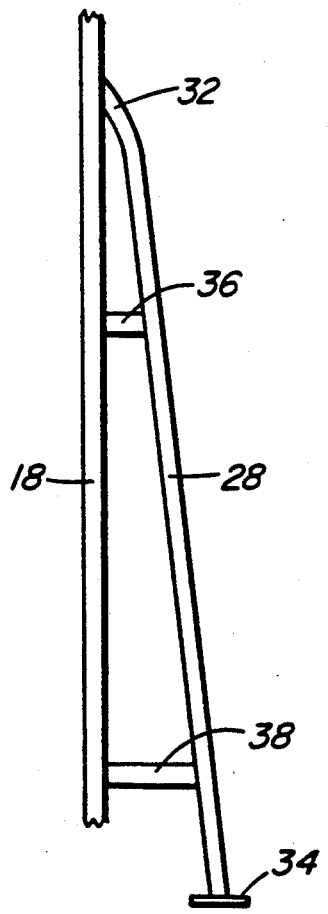
FIG. 1*a* is a side elevation of a support post, shown in fragment, and a support picket for the apparatus of FIG. 1.

There are support pickets 28 and 30 welded alongside each of the posts for added support. Support picket 28 is better seen in FIG. 1*a* and is angled slightly with respect to the post. It is welded to the post at top 32 thereof and to base plate 34 at the bottom thereof. Horizontal bars 36 and 38 are welded between the post and the support picket.

Figure 5:
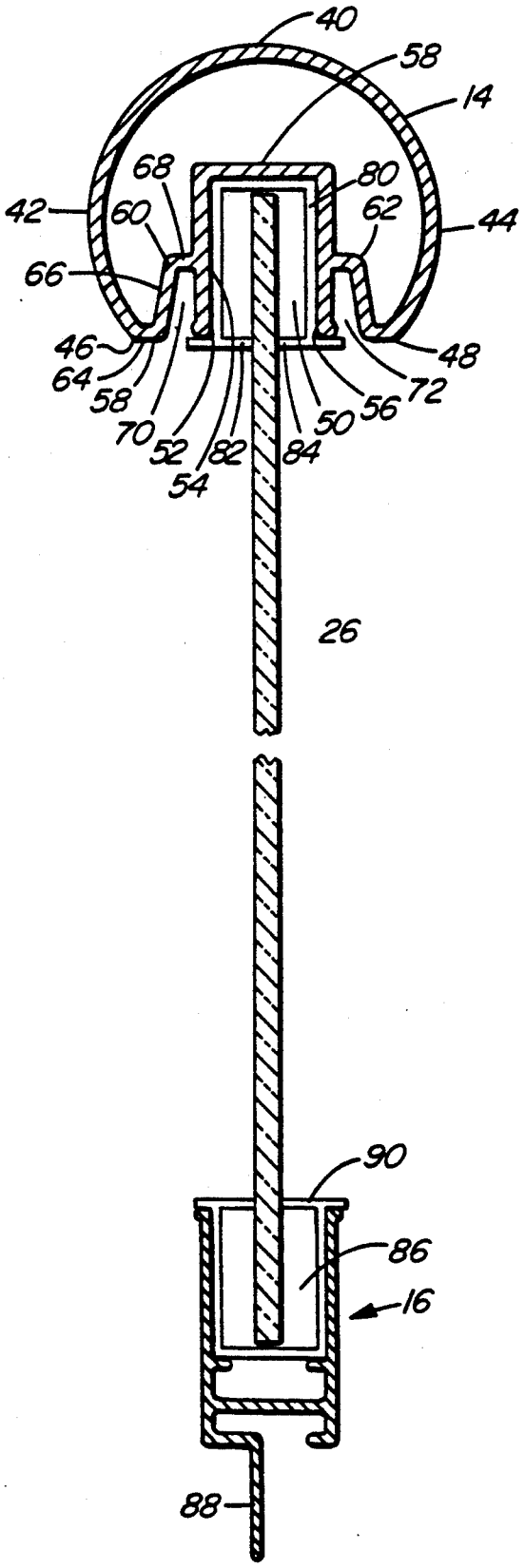
FIG. 5 is a sectional view taken along line 5—5 of FIG. 1.

Top railing member 14 is best seen in the isometric view of FIG. 2. The member in this embodiment is an aluminum extrusion. In FIG. 1 the member is shown slightly longer than the span between the support posts 18 and 20. However, the length of the member is idefinite with the required number of support posts located thereunder. The span of the top railing member need not be broken by intermediate support posts. In this embodiment the top railing member has a top 40 with sides 42 and 44. The top and sides are partly circular in section as best seen in FIG. 5. They form the portion of the top railing member which is normally grasped by someone using the railing assembly. The sides 42 and 44 have bottom edges 46 and 48 respectively.

There is a picket-receiving channel 50 which extends inwardly and upwardly from the bottom of the top railing member. It has a open bottom 52 and straight, parallel sides 54 and 56. The sides are grooved for frictionally receiving pickets as described below. The channel has a bottom 58 which connects the sides.

There are two connecting portions 60 and 62 near the bottom of the railing member which extend between the channel 50 and the sides 42 and 44. These connecting portions are mirror images of each other, so only one connecting portion is described in detail. It includes a flat outer surface 64 which extends on one side of channel 50. The flat outer surface is adjacent side 42 of the top railing member. Connecting portion 62 also has a part 66 which extends generally parallel to the sides of the channel although at a slight angle in this embodiment. Part 66 of the connecting protion is connected to side 54 of the channel by a part 68 which is parallel to surface 64. Thus a lateral channel 70 is formed alongside picket receiving channel 50. In the same manner, connecting portion 62 forms a lateral channel 72 on the opposite side of picket-receiving channel 50.

Figure 6:
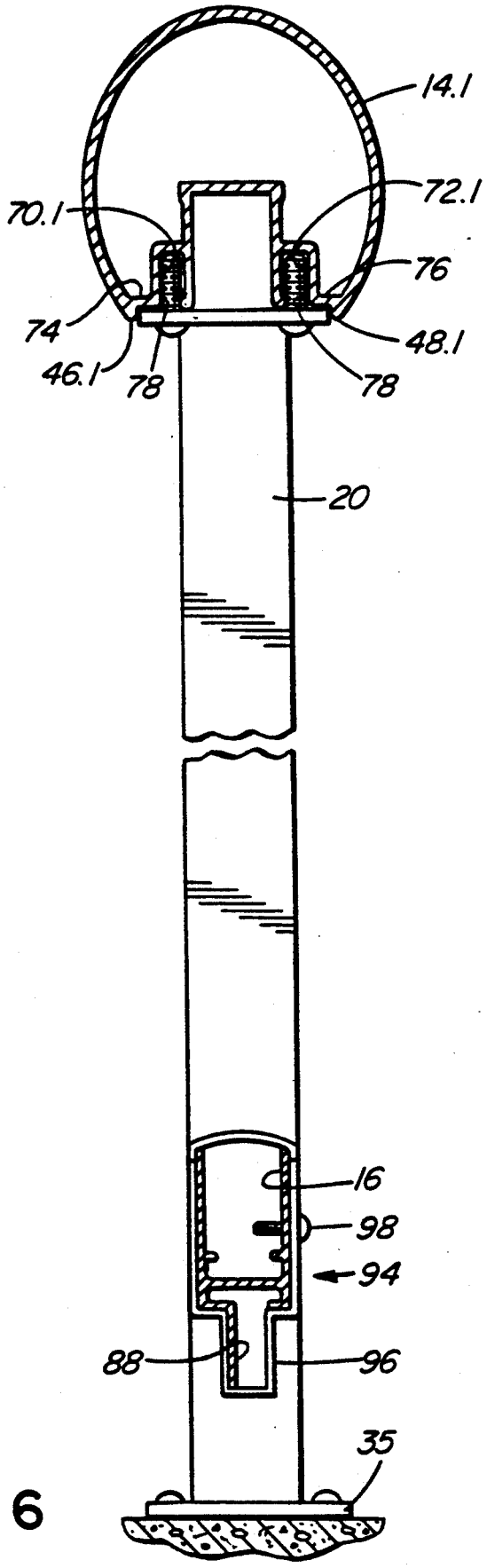
FIG. 6 is a sectional view taken along line 6—6 of FIG. 1 but showing the elliptical top railing member.

An alternative top railing member 14.1 is shown in FIG. 3 and 6 where like parts have like numbers with the addition of "0.1". In this case it may be observed that top railing member 14.1 is partly elliptical in shape instead of being partly circular as in the previous embodiment. As shown in FIG. 3, instead of having the flat outer surfaces of the connecting portions and the bottom of the channel flush with the bottom edges of the sides of the member, flat outer portion 64.1 of connecting portion 60.1 and bottom 52.1 of channel 50.1 are recessed slightly so that the bottom edges 46.1 and 48.1 of the sides project downwardly slightly beyond the bottom of the channel. The flat outer surfaces of the connecting portions form a recess 74 extending along the bottom of the member. The rectangular mounting plate 76 on the top of each of the mounting posts can be fitted within the recess 74 as seen for post 18 in FIG. 6. The posts are connected to the top railing member by means of a plurality of screws 78 which extend upwardly through apertures through the mounting plate 76 and are threadedly received in the lateral channels 70.1 and 72.1 of the top railing member. In the embodiment of FIG. 1, 2, and 5, the mounting plate of each post is similarly received against the flat outer surfaces 62 and 64 of the connecting portions, although there is no recess along the bottom of the member. In either case, it may be observed that this method of mounting the top railing member on each post is permitted by the relatively flat bottom of the top member. The bottom of the channel projects no lower than the flat outer surfaces of the connecting portions and the bottom edges of the sides of the member.

A further top member 14.2 is shown in FIG. 4. Like parts have like numbers as FIG. 2 with the addition of "0.2". Member 14.2 is generally rectangular in section with a convex top 40.2 and straight parallel sides 42.2 and 44.2. As in the embodiment of FIG. 3, the bottom edges 46.2 and 48.2 of the sides project downwardly beyond bottom 52.2 of channel 50.2. Otherwise, the configuration at the bottom is the same as for the embodiment of FIG. 3.

The pickets 22 and 24 in FIG. 1 are tightly received at their tops within channel 50 of the top railing member. This is observed for picket 22.1 in FIG. 3. Each of the pickets in these embodiments is a rectangular aluminum tube. Likewise, the top of glass panel 26 is received in channel 50 within a weather seal 80 shown in FIG. 5. The weather seal is of pvc in this example and is also channel-shaped, but slightly smaller than channel 50 for fitting tightly therein. The seal has flat, perpendicular edges 82 and 84 on it outer ends for tightly receiving glass panel 26 therebetween.

The bottom railing member 16 from the assembly 10 of FIG. 1 is best seen in the sectional view of FIG. 5. It may be observed that the bottom railing member is substantially U-shaped in section, having an upwardly open channel 86 adjacent the top thereof and a downwardly extending flange 88 connected to the bottom of the channel. The channel 86 receives the bottoms of the pickets 22 and 24 in the same way that the tops of the pickets are tightly received within channel 50 of the top railing member. The bottom of glass panel 26 is also received in the channel within a seal 90 which is the same as seal 80 in the top railing member.

The bottom railing member 16 is received within bottom railing sleeves 92 and 94 which are connected to the posts 18 and 20 respectively as seen in FIG. 1. As seen in better detail in FIG. 6 for sleeve 94, the sleeves are open topped channels with a slightly narrower projection 96 on the bottoms thereof for receiving flange 88 regardless of which way the bottom railing member is turned. The bottom railing sleeves are connected to the posts by welding in this example. A screw 98 extends through apertures in each of the sleeves and the bottom railing member to secure the bottom railing member in place.

Base plate 34 of post 18 and the corresponding base plate 35 of post 20 are typically installed by bolts extending through apertures in the plates which extend into the surface 12. Other means for securing the plates could be used depending upon the nature of the surface.

It will be understood by someone skilled in the art that many of the details provided above are by way of example only and can be altered without departing from the scope of the invention which is to be interpreted with reference to the following claims.

What is claimed is:

1. An aluminum railing member comprising a hollow extrusion with a top, sides, a bottom having a picket-receiving, longitudinal channel with an open bottom and parallel sides, the sides having bottom edges extending downwardly to the bottom of the channel, and connecting portions adjacent the bottom which extend between the channel and the sides of the extrusion, the connecting portions having parts parallel to the sides of the picket receiving channel and spaced apart therefrom, forming lateral channels on each side of the picket-receiving channel.

2. A railing member as claimed in claim 1, wherein the connecting portions include flat outer surfaces extending on each side of the picket receiving channel.

3. A railing member as claimed in claim 2, wherein the flat outer surfaces are adjacent the sides of the railing member.

4. A railing member as claimed in claim 3, wherein the bottom edges of the sides extend downwardly beyond the flat outer surfaces and the bottom of the picket-receiving channel.

5. A railing member as claimed in claim 1, which is semi-elliptical in section.

6. A railing member as claimed in claim 1, which is a partial circle in section.

7. A railing member as claimed in claim 1, which is rectangular in section.

8. An aluminum railing assembly, comprising:

a top railing member having a top, sides and a bottom having a picket-receiving, longitudinal channel with an open bottom and parallel sides, the sides having bottom edges extending downwardly to the bottom of the channel and the top railing member having connecting portions along the bottom which extend between the picket-receiving channel and the sides and have flat outer surfaces adjacent the sides, the tops of the support posts being flat plates received against the flat outer surfaces of the connecting portions the connecting portion having parts parallel to sides of the picket receiving channel and spaced apart therefrom, forming lateral channels on each side of the picket receiving channel;

a bottom railing member below the top railing member and spaced-apart therefrom, the bottom railing member having a top and a picket-receiving channel with an open ended top;

a plurality of spaced-apart support posts extending perpendicularly between the top railing member and the bottom railing member, each said support post having a flat top received against the bottom of the top railing member on each side of the picket-receiving channel thereof; and a plurality of pickets extending vertically between the railing members, each said picket having a top in the picket-receiving channel of the top railing member and a bottom in the picket-receiving channel of the bottom railing member.

9. An assembly as claimed in claim 8, wherein the flat outer surfaces of the connecting portions and the bottom of the channel of the top railing member are recessed with respect to the bottom edges of the sides of the top railing member.

10. An assembly as claimed in claim 8, wherein the support posts are connected to the top railing member by means of screws extending through apertures in the plates at the tops of the posts, the screws being threadedly received in the lateral channels of the top railing member.

11. An assembly as claimed in claim 8, further including rectangular panels between the pickets and between the top railing member and bottom railing member.

* * * * *